US005556200A

United States Patent [19]

Ekholm et al.

[11] Patent Number: 5,556,200

[45] Date of Patent: Sep. 17, 1996

[54] APPARATUS FOR MIXING A FIRST FLUID INTO A SECOND FLUID USING A WEDGE-SHAPED, TURBULENCE-INDUCING FLOW RESTRICTION IN THE MIXING ZONE

[75] Inventors: Rolf Ekholm; Ulf Jansson, both of Karlstad, Sweden

[73] Assignee: Kvaerner Pulping Technologies Aktiebolag, Sweden

[21] Appl. No.: 430,595

[22] Filed: Apr. 28, 1995

Related U.S. Application Data

[63] Continuation-in-part of Ser. No. 222,942, Apr. 5, 1994, abandoned.

[30] Foreign Application Priority Data

Feb. 7, 1994 [SE] Sweden ..... 9400387
Sep. 9, 1994 [SE] Sweden ..... 9403010

[51] Int. Cl.[6] ..... B01F 5/06

[52] U.S. Cl. ..... 366/175.2; 366/176.2; 366/181.5; 138/46; 261/62; 261/DIG. 76

[58] Field of Search ..... 366/132, 174.1, 366/175.2, 176.1, 176.2, 181.5, 181.7, 332, 336, 337, 340; 162/57, 243; 261/62, DIG. 76; 48/189.4; 138/40, 44–46

[56] References Cited

U.S. PATENT DOCUMENTS 2,021,092 11/1935 Teliet .
2,312,639 3/1943 Gronemeyer .
3,376,023 4/1968 Lage .
3,734,111 5/1973 McClintock ..... 366/174.1 X
4,191,480 3/1980 Hiorth ..... 366/336
5,181,987 1/1993 Breuker et al. .
5,240,326 8/1993 Evanson .
5,366,288 11/1994 Dahllof et al. ..... 366/176.2

FOREIGN PATENT DOCUMENTS 468341 12/1992 Sweden .

*Primary Examiner*—Charles E. Cooley
*Attorney, Agent, or Firm*—Ronald P. Kananen

[57] ABSTRACT

An apparatus for mixing a first fluid into a second fluid that comprises a housing (1) having a flow chamber (39) for the second fluid, a flow restrictor member (6) in the flow chamber, and holes (18) for introducing the first fluid into at least one gap (15, 16) between the flow restrictor member and those walls (5, 10) of the flow chamber (39) facing towards the flow restrictor member. The flow restrictor member and flow chamber, in a plane transversely to the principal flow direction (31) of the second fluid, each has the shape of a wedge. Gaps (15, 16) are formed between each of those two sides of the flow restrictor member that converge in a wedge shape and those walls of the wedge-shaped chamber facing towards the flow restrictor member. The holes (18) for introducing the first fluid are disposed in the region of the gaps (15, 16).

20 Claims, 5 Drawing Sheets

APPARATUS FOR MIXING A FIRST FLUID INTO A SECOND FLUID USING A WEDGE-SHAPED, TURBULENCE-INDUCING FLOW RESTRICTION IN THE MIXING ZONE

This application is a continuation-in-part of applicants' U.S. application Ser. No. 08/222,942, filed Apr. 5, 1994, now abandoned.

BACKGROUND OF THE INVENTION

1. Field of the Invention

The present invention relates generally to an apparatus for mixing a first fluid into a second fluid, and particularly to an apparatus for mixing a fluid, preferably a gaseous fluid such as, for example, steam, ozone or oxygen gas, into a cellulose pulp suspension.

2. Description of the Prior Art

The heating of liquids and suspensions by means of direct steam can be difficult to carry out for a large number of reasons. One is the difficulty of atomizing the steam and simultaneously keeping the suspension in such motion that a smooth and continuous condensation takes place, which requires, namely, that the steam is evenly atomized in the liquid or suspension. This is especially difficult when a large quantity of steam is supplied. When steam is added, it occurs, moreover, that the volume of the steam bubbles can be so great that the convection of heat between the steam and the liquid is insufficient for the desired continuous condensation. Because of this, intermittent, violent steam implosions arise, causing shocks and vibrations. These can be so violent that mechanical damage is incurred. The damage is accentuated as the quantity of steam to be added increases.

In general, a number of requirements can be placed upon a steam mixer. The steam should be added such that local surpluses do not occur during passage through the mixer. The degradation or so-called fluidization must take place in such a way that local pressure variations are minimized. Any implosions which occur because of steam bubbles should take place in a section in which the components or the construction material cannot suffer damage resulting from the cavitation-like phenomena. The mixer should have some form of in-built elasticity to enable it to absorb pressure and shocks caused by possible momentary disturbances in the steam and pulp flows up to and through the mixer.

A large number of apparatuses for mixing a gaseous fluid into a pulp suspension are known. The Swedish Patent No. 468 341 describes an apparatus for mixing a suspension of a cellulose-containing fibre material and a fluid such as, for example, gases in the form of ozone, oxygen and chlorine and liquids containing various active substances, e.g., chlorine dioxide. In its basic principle, this mixer comprises a funnel-shaped part and, within the funnel-shaped part, a conical moving part. Between the funnel-shaped part and the conical part there is formed an adjustable gap through which the pulp passes. In the walls of the funnel-shaped part there are located a number of openings for the fluid which is to be mixed into the passing pulp. Drawbacks with this apparatus are that it is relatively large, that its installation, especially in existing pipe systems, is complicated, since the flow direction of the pulp alters in the mixer, requiring that the pipe system to which the mixer is to be connected has to be redirected, and that the mixer requires some form of stand or base on which to be mounted.

Also common are mixer devices having a rotary part for mixing fluid into the pulp. A problem in these devices is that the rotation gives rise to large pressure variations, which create local zones of very low pressure to which the steam makes its way, resulting in implosions as described above. A further problem is to distribute the steam evenly in the pulp suspension, especially when large quantities of steam are to be supplied, as a result of which capacity problems can also arise.

SUMMARY OF THE INVENTION

The object of the present invention is to remedy the problems of the prior art described above. Additional objects, advantages and novel features of the invention will be set forth in the description which follows, and will become apparent to those skilled in the art upon reading this description or practicing the invention. The objects and advantages of the invention may be realized and attained by the appended claims.

To achieve the foregoing and other objects and in accordance with the purpose of the present invention, as embodied and broadly described herein, there is therefore proposed a blending or mixer apparatus which does not have any rotary parts, which does not presuppose that the second fluid, which can consist, for example, of a pulp suspension, does not require that the flow alters its principal flow direction, thereby making the apparatus suitable for installation in existing pipe systems, which is compact in its construction, and which does not require a stand or base for its mounting.

These and other objects and advantages of the invention can be achieved by an apparatus for mixing a first fluid into a second fluid, which apparatus comprises a housing having a flow chamber for the second fluid, a flow restrictor member in the flow chamber, and means for introducing the first fluid into at least one gap between the flow restrictor member and those walls of the chamber facing towards the flow restrictor member. The objects and advantages are further achieved by virtue of the additional characteristics of the invention specified in the subsequent patent claims. Further characteristics and advantages of the invention can be derived from the following description of a preferred embodiment.

BRIEF DESCRIPTION OF DRAWINGS

In the following description of a preferred embodiment, reference will be made to the appended drawings, in which.

DETAILED DESCRIPTION OF A PREFERRED EMBODIMENT

Figure 1:
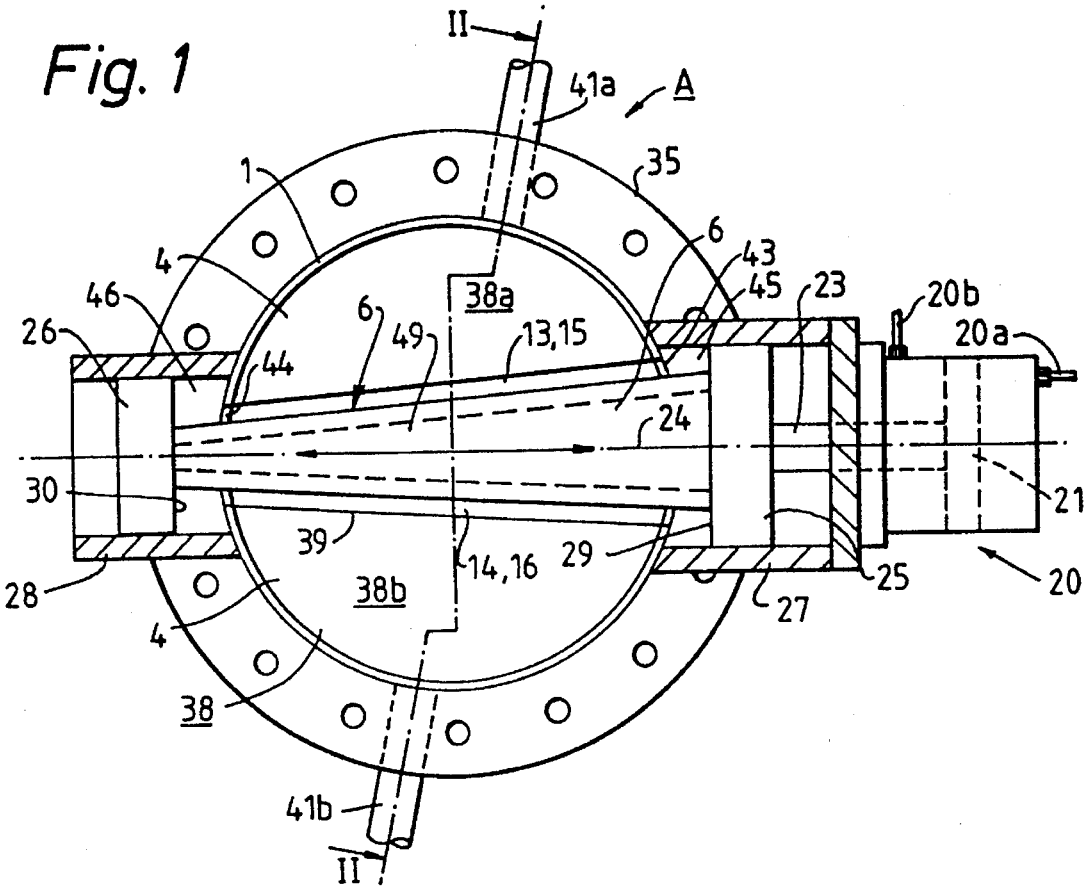
FIG. 1 is a partially cut-through end view of the apparatus according to the present invention.

Reference will now be made in detail to the preferred embodiments of the invention, examples of which are illustrated in the accompanying drawings.

FIGS. 1 to 4 show details of a first embodiment of an apparatus A of the present invention. Apparatus A comprises a main body 1 (hereinafter referred to as "the housing") that in turn exhibits a tubular or sleeve-shaped outer wall 36, a first plane end wall 37, a second end wall 38, that can also be plane but which, according to the embodiment, is inwardly conical, and between the first and second end walls a continuous elongated opening 39 (hereinafter referred to as "the flow chamber"). The flow chamber 39 is limited to the sides by a pair of plane chamber walls 5, 10. The shape of the flow chamber 39 will be described in greater detail below.

The flow chamber 39 divides the first, plane end wall 37 into two circular-segment shaped portions 37*a* and 37*b* and the second end wall 38 is also correspondingly divided into two portions 38*a* and 38*b*. The portions 38*a* and 38*b* can be described as conical segments or plane, circular segments in the event of the end wall 38 being plane. Between the outer wall 36 and the walls 5, 37*a* and 38*a* there is formed a first outer space 40*a* and at the other side of the housing 1 there is correspondingly formed a second outer space 40*b*. Leading to the first and second outer spaces 40*a*, 40*b* are supply lines 41*a*, 41*b* for the fluid which has been referred to above as the first fluid which is to be mixed into the second fluid. According to the embodiment, the first fluid is intended to consist of steam, but can also, in other applications of the apparatus, consist of other gaseous fluids, e.g., oxygen, ozone, chlorine dioxide and/or a variety of liquids.

The apparatus A is fastened, by means of the housing 1, between two pipelines 32, 33, which, according to the embodiment, have the same diameter as the outer wall 36 of the housing 1. A different diameter is also, however, conceivable. The fastening can be realized in a conventional manner by a flange joint. A pair of flanges on the housing 1 are denoted by 34, 35. The flanges 34, 35 can be secured to corresponding flanges on the pipelines 32, 33 in a known manner. The apparatus A having the housing 1 is herein facing such that the second fluid flows from the line 32 up through the flow chamber 39 and onward up through the pipeline 33. The housing 1 is positioned with the plane, first end wall 37 facing towards the incoming pipeline 32 for the second fluid, and with the inwardly conical, second end wall 38 facing towards the outgoing line 33.

At both ends of the flow chamber, the outer wall of the housing 1 is breached, thereby forming lateral openings 43 and 44. Through these openings 43, 44, the flow chamber 39 communicates with a pair of first and second cylinder spaces 45 and 46, respectively, disposed outside the housing 1. First and second cylinders 27 and 28 are associated with the first and second cylinder spaces 45 and 46 and are welded to the outer wall 36 of the housing 1. In the cylinders 27, 28 there are located a first and a second piston 25 and 26, respectively. The first piston 25 is further connected by a piston rod 23 to a hydraulic piston 21 in a hydraulic cylinder 20. A pair of supply lines for hydraulic oil are denoted by 20*a*, 20*b*. Instead of hydraulic operation, pneumatic operation can also be used. In that event, the cylinder 20 would consist of a pneumatic cylinder and the lines 20*a*, 20*b* would be air lines.

In the flow chamber 39 there is disposed a flow restrictor member 6, which extends from the first cylinder space 45, through the first lateral opening 43, onward through the whole of the chamber 39 and, via the second lateral opening 44, into the second cylinder space 46. At the same time as the flow restrictor member 6 constitutes a restrictor member in the flow chamber 39, it also constitutes a connecting element between the two pistons 25 and 26. The pistons 25 and 26 are connected to both ends of the flow restrictor member 6.

Figure 4:
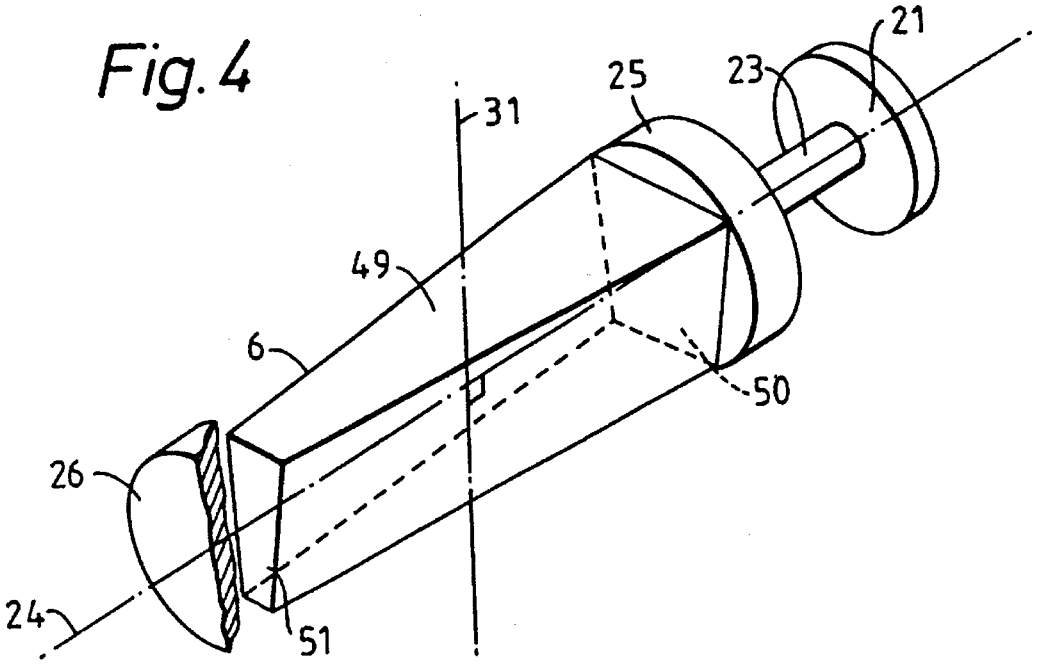
FIG. 4 is a perspective view of a flow restrictor member forming part of the apparatus.

The appearance of the integrated member, which consists of the flow restrictor member 6, the first and second pistons 25, 26, the piston rod 23 and the hydraulic or pneumatic piston 21, is shown in FIG. 4. The longitudinal axis of the flow restrictor member 6, also the center axis for the pistons 25 and 26, has been denoted by 24. This is perpendicular to the center line 31 of the housing 1, which at the same time is the principal flow direction for the second fluid which is transported through the pipelines 32 and 33 and into which the first fluid is to be blended.

Figure 2:
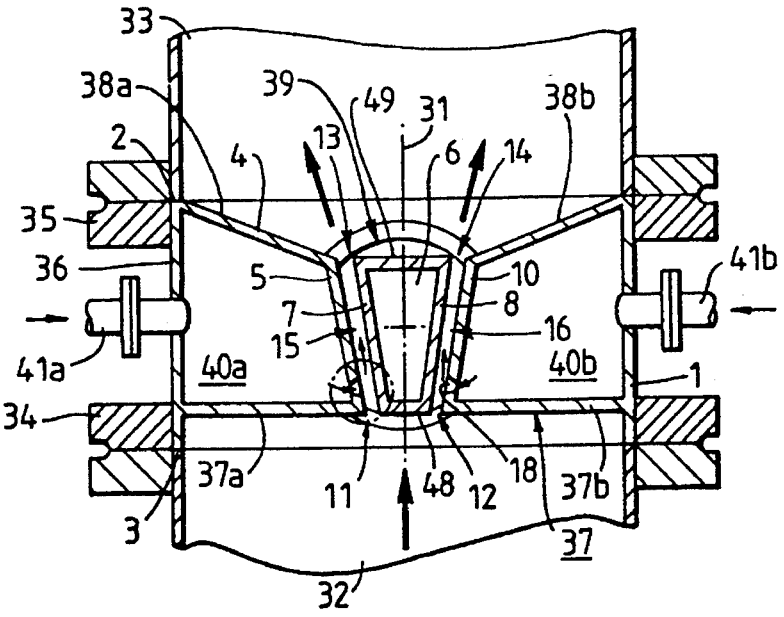
FIG. 2 is a side view in section taken along the line II—II in FIG. 1.
Figure 3:
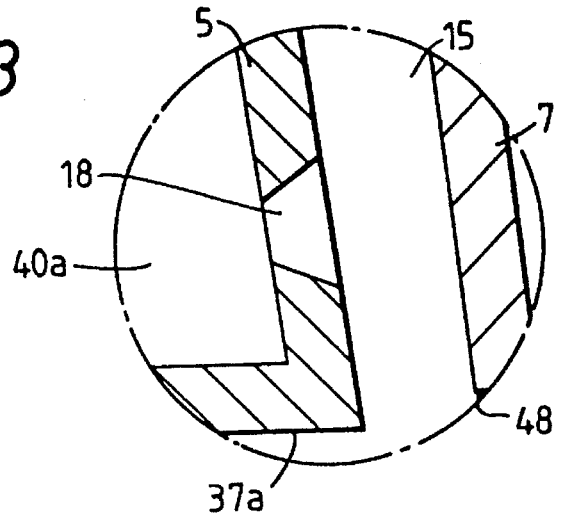
FIG. 3 is a part view in section taken from FIG. 2, showing the embodiment of the distribution member.

As can be seen from FIGS. 1, 2 and 4, the flow restrictor member 6 has the general shape of a six-sided polyhedron limited by a pair of side walls 7, 8, a bottom wall 48, a top wall 49, a rear end wall 50, which is joined to the first piston 25, and a front end wall 51, which is joined to the second piston 26. More specifically, the flow restrictor member 6 is double wedge-shaped in that it is wedge-shaped both in its longitudinal direction, i.e., in the direction of the axis 24, by virtue of the two side walls 7, 8 converging towards each other in a wedge shape, in the direction of the axis 24, from the rear end wall 50 towards the front end wall 51, and in the transverse direction, by virtue of the same end walls 7, 8 also converging towards each other in a wedge shape, in the direction of the axis 31, from the top wall 49 towards the bottom wall 48 facing towards the inflowing second fluid.

The flow chamber 39 has a shape which is approximately uniform with the shape of the flow restrictor member 6. When the flow restrictor member 6 is symmetrically placed in the flow chamber 39, the side walls 7, 8 of the flow restrictor member, however, form a small angle with the side walls 5 and 10, respectively, of the chamber 39. There is thus formed between the walls 5, 7 and 8, 10, respectively, a gap 15 and 16, respectively, which widens somewhat in the flow direction. These two gaps 15, 16 constitute passages for the second fluid which is to pass from the pipeline 32, through the apparatus A according to the invention, to the second line 33. In principle, the walls which define the gaps 15, 16 can be parallel in the position of symmetry, but the small deviation from parallelism and hence the widening gap shape is to be preferred.

The apparatus A further comprises means for introducing the first fluid, which in the envisaged application should be constituted by steam, into the gaps 15, 16. These means comprise, on the one hand, the two outer spaces 40*a* and 40*b* and the supply lines 41*a*, 41*b* to these spaces and, on the other hand, holes 18 in the side walls 5 and 10 of the flow chambers 39. These holes 18 are distributed along the length of the side walls 5, 10 and are preferably disposed closer to the inlet openings 11 and 12, respectively, of the two gaps 15 and 16 than the outlet openings 13 and 14, respectively. The holes 18 can be configured, for example, as circular holes or as gaps or slots. The term "hole" should therefore not be given any restrictive meaning, but should cover all through openings, slots, etc., regardless of shape.

In axial section, the holes have a shape which widens from the outer spaces 40*a*, 40*b* to the gaps 15, 16. This shape is particularly suitable where the second fluid, which flows up through the gaps 15, 16, is a fibre-containing suspension. If the supply of the second fluid (i.e., the mix-in fluid) through the supply lines 41*a*, 41*b* is interrupted while cellulose containing fiber material continues to flow through the apparatus A, then the holes 18 are blocked by the fiber material. The fiber material therefore does not penetrate into the outer spaces 40*a*, 40*b*. When steam or a different blend-in fluid is turned on again through the lines 41*a* and 41*b* into the spaces 40*a* and 40*b*, respectively, this fluid will blow away the fiber plugs in the holes 18, so that the holes again become ready for use.

As a variant or improvement, the holes, slots or equivalent 18 can be disposed in separate exchangeable plates. The separate plates can be screw-fastened and can fill a larger opening in the side walls 5, 10. By having access to a number of such exchangeable plates, which can be provided with a different number of holes 18 or with holes 18 of different shape, location, size etc., the user can acquire increased opportunities to adapt the inflow of the first fluid, in the present case steam, to other conditions. If, for example, the production conditions should alter in the larger installation of which the apparatus according to the invention constitutes a part, an exchangeable plate can be replaced so that a plate is obtained having holes matched to the altered production conditions.

It is also in fact possible to supply the steam or other first fluid via the flow restrictor member 6, in which case openings are correspondingly disposed in the side walls 7, 8 of the flow restrictor member, preferably close to the inlet openings 11, 12 of the gaps 15, 16.

Figure 8:
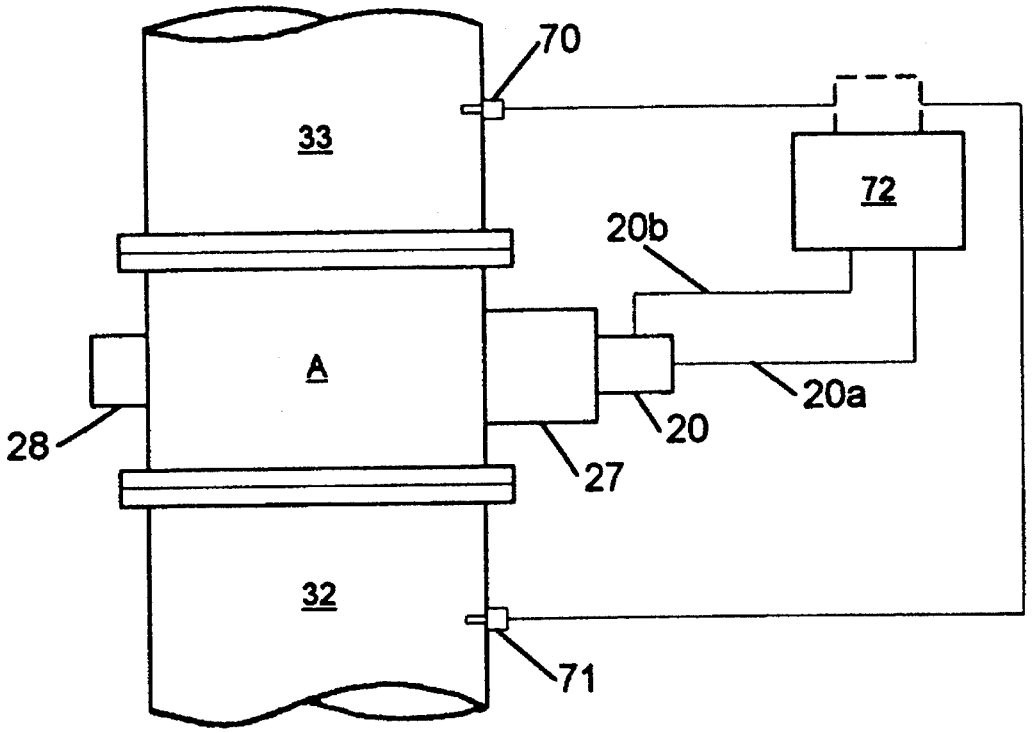
FIG. 8 schematically shows an arrangement for controlling the movements of the flow restrictor element.

Also forming part of the equipment are pressure-detecting sensors 70, 71 (FIG. 8), mounted upstream and downstream of the apparatus, respectively, and a governor device 72 for controlling the piston 21 by influencing the flow in the lines 20*a*, 20*b*. By moving the piston 21, the wedge-shaped flow restrictor member 6 can be moved in the longitudinal direction of the flow restrictor member (i.e., transversely to the principal flow direction for the pulp suspension or equivalent other fluid flowing through the apparatus A). Movement of the restrictor member allows the width of the gaps 15, 16 and hence also the flow through the apparatus to be regulated.

In the following description of how the apparatus functions, it is presupposed that the fluid which flows up through the pipelines 33, 34, and which in the patent claims and in the preceding text is referred to as the second fluid, is a suspension of cellulose fiber pulp in water, and that the first fluid, which is to be introduced into this suspension, is steam.

The pressure-detecting sensors 70, 71 and the governor device 72 measure or receive the measurement values of the pressures in the fiber pulp suspension upstream and downstream of the apparatus A in order to register a pressure differential. The governor device 72 compares the registered pressure differential with a predefined desired value, which is set in dependence upon prevailing production conditions such as temperature, consistency, pulp type and capacity. This setting is preferably made automatically.

The governor device 72 activates the control cylinder 20 by regulating the pressure and/or flow through the hydraulic lines 20*a* and 20*b*, so that the flow restrictor member 6 is shifted forwards or backwards in the direction of the axis 24 (i.e., transversely to the principal flow direction coinciding with the axis 31), in order to set the gaps 15, 16 to the desired width.

If, for example, the pressure increases on the inlet side (i.e., in the pipeline 32), this is registered by the sensors 70, 71 and governor device 72, so that the control cylinder 20 is activated and moves the flow restrictor member 6 transversely to the principal flow direction 31, so that the width of the gaps 15, 16 increases. The increased flow area makes it possible for the blockage to be dispersed and for a greater pulp flow to be obtained until the pressure on the inlet side drops and the pressure differential returns to normal. The control cylinder 20 is then re-activated, so that the widths diminish. This operation continues to be repeated until a stable state is achieved.

The flow restrictor member 6 is controlled in its axial movements by the pistons 25, 26 in the cylinders 27, 28, so that the longitudinal axis 24 of the flow restrictor member 6, which at the same time constitutes the center axis for the pistons 25, 26, will always coincide with the plane of symmetry of the flow chamber 39. This plane of symmetry coincides with the principal flow direction 31 in the apparatus A. The flow restrictor member 6 is nevertheless able to wobble, by small rotational movements, about its center axis 24, due to the fact that the bearing pistons 25, 26 are cylindrical. This means that if one of the gaps 15, 16 begins to be blocked, the pressure in the other gap will increase, preferably in the region of the outlet passages 13 or 14. This unbalanced pressure on the one or other of the side walls 7 or 8 generates a torque which turns the restrictor member 6 about its center axis 24, thereby increasing the gap width where the gap is in the process of being blocked. By increasing the gap width in the critical blockage region, the blockage or "plugging" can be made to work loose. Above all, however, blockage of the gaps by the mounting of the flow restrictor member 6 in the cylinders 27, 28 is avoided due to the fact that the constant pressure variations which arise in the two gaps 15, 16 generate constant, small rotational movements of the flow restrictor member 26, which inhibits blockage.

The pressure from the fluid flowing in the gaps 15, 16 acts upon the inner sides 29, 30 of the bearing pistons 25, 26 via the lateral openings 43, 44. The first piston 25, which is placed closest to the control cylinder 20, has an inner surface 29 which is larger than the surface 30 belonging to the other piston 26, which means that the pressure from the flowing fluid endeavors to press the flow restrictor member 6 in the direction of the control cylinder 20. This means that the control cylinder 20 operates for the most part with a counter-pressure in order to resist the pressure from the flowing medium.

Where appropriate, a damping in the form of a pressure can be imposed upon the other side of the control cylinder 20 so as to dampen the movements from the flow restrictor member 6. A certain freedom of movement in the longitudinal direction 24 of the flow restrictor member 6 is nevertheless desirable since pressure variations in the second fluid, which flows up through the apparatus A, and the counter-pressure from the control cylinder 20 can generate oscillating longitudinal movements of the flow restrictor member 6, which also counteract blockage or "plugging" of the gaps 15, 16. Where appropriate, the apparatus A may also be provided with a vibrator, which is connected up to the bearing piston 26 and acts in the longitudinal direction of the flow restrictor member 6.

In order to control the flow of the second fluid (i.e., the pulp suspension), the narrower surface 48 of the wedge-shaped flow restrictor member 6 can be extended by a projecting guiding body.

Modified embodiments of the apparatus according to the invention will be described below with reference to FIGS.

Figure 5:
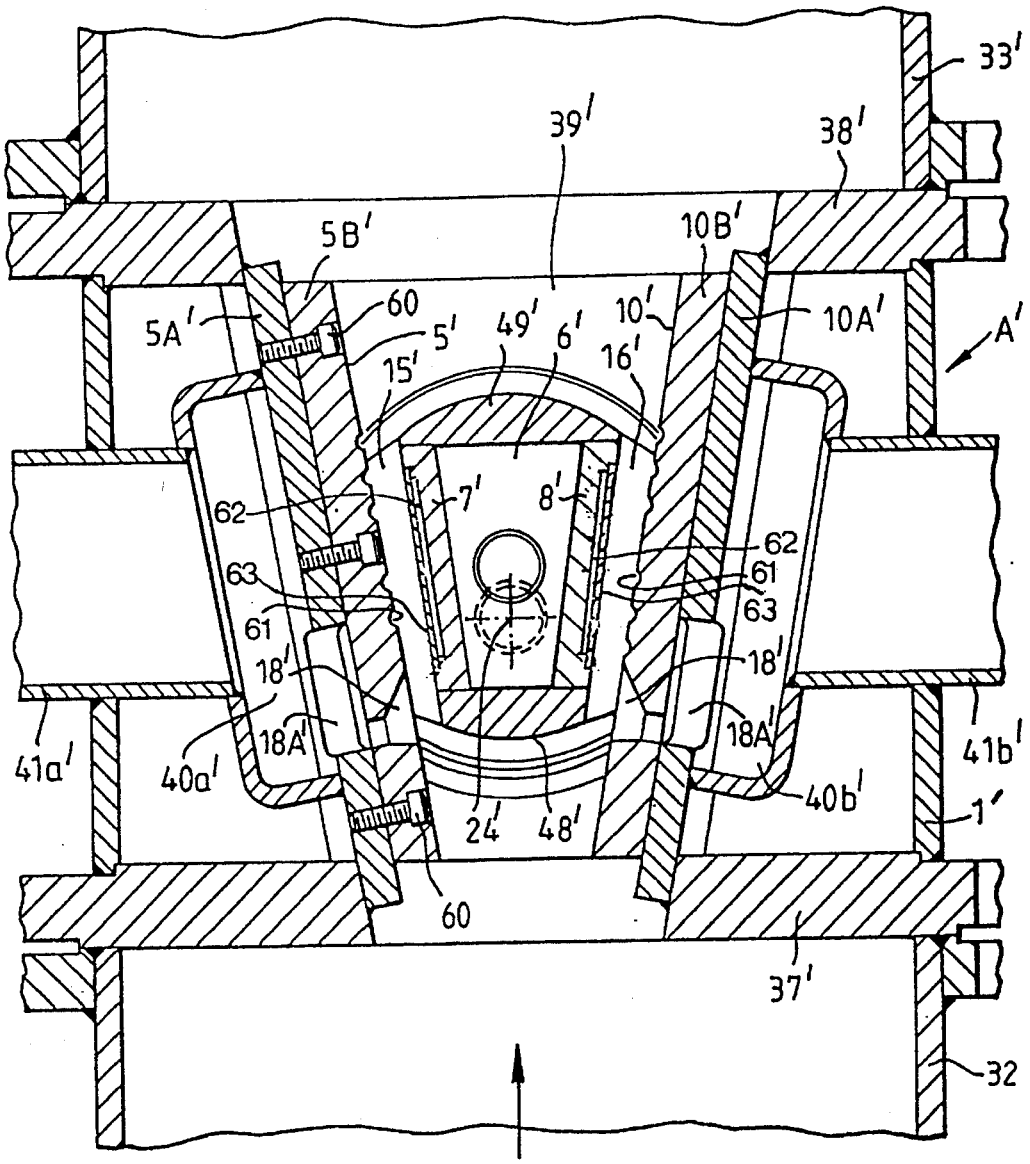
FIG. 5 is a side view in section of an apparatus according to a modified embodiment of the invention taken along the corresponding section shown in FIG. 2.
Figure 6:
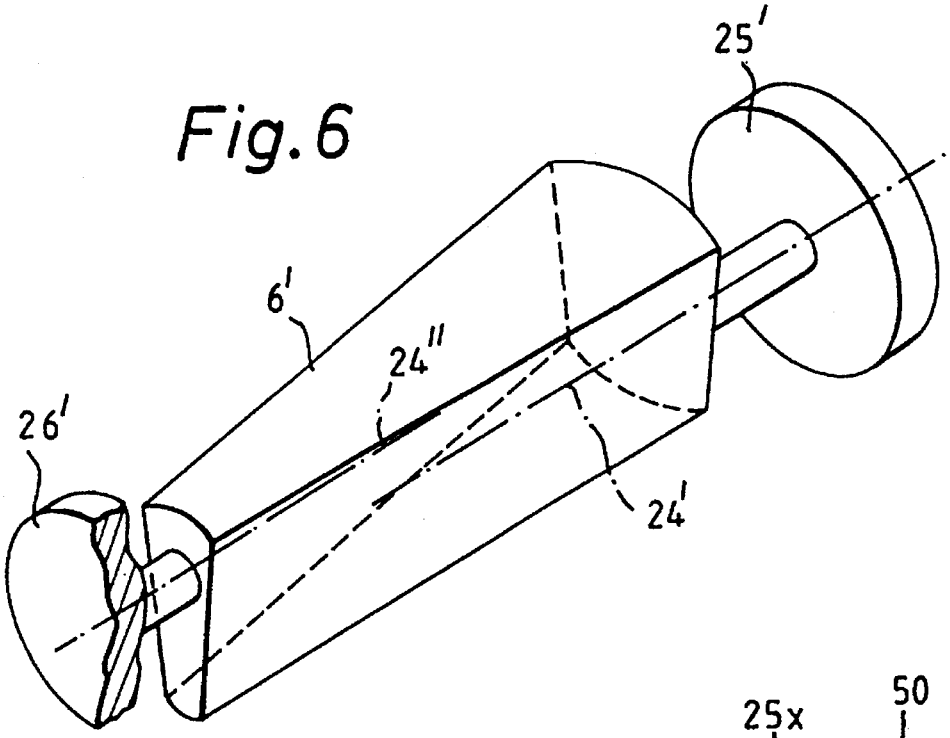
FIG. 6 is a perspective view of a flow restrictor member included in an apparatus according to a modified embodiment of the invention.

5–7. In FIGS. 5 and 6, details which have a direct correspondence in FIGS. 1–4 have the same reference numerals with the addition of a prime symbol, and in FIG. 7 with the addition of an "x."

The apparatus A' (FIG. 5) comprises a main body or housing 1', with a first flat end wall 37' and a second flat end wall 38'. Between the first and second end walls 37', 38' a flow chamber 39' is provided with the same general form as the flow chamber 39 in the previous embodiment. The apparatus A' is mounted between the two pipelines 32' and 33' by means of flange connections analogous with the previous embodiment.

In the flow chamber 39' there is disposed a flow restrictor member 6' which is essentially formed as a six-sided polyhedron limited by a pair of side walls 7',8', a curved bottom wall 48' and a curved upper wall 49'. Otherwise, the flow restrictor member 6' may be designed in analogy with the flow restrictor member 6 in the previous embodiment. However, it might be suitable to displace the center axis 24' for those pistons (corresponding to pistons 26, 27 in the previous embodiment, which control the movements of the flow restrictor member 6') closer to the bottom wall 48' in order to center the flow restrictor member 6' under influence of the fluid flowing through the flow chamber 39'.

According to the embodiment, the two side walls 5' and 10' of the flow chamber 39' consist of a pair of double plates, namely an outer plate 5A', 10A' which is securely welded to the end walls 37', 38', and an inner plate 5B', 10B' which is detachably attached to the respective outer plate 5A', 10A' by means of bolts 60. Between the two inner plates 5B' and 10B' and the side walls 7' and 8' of the flow restrictor member 6', respective gaps 15' and 16' are provided in the same manner as for the previous embodiment.

According to the embodiment, the sides of the walls 5B' and 10B' facing the gaps 15' and 16' are provided with elongated recesses or grooves 61 in order to increase the turbulence of the fluid flowing through the gaps 15', 16' and thereby further improve the mixing of the second fluid which is to be mixed with the first fluid in the gaps 15', 16'. In the lower part of each inner side plate 5B' 10B', a series of holes 18' are provided for introducing the first fluid into the gaps 15', 16'. Behind these holes, an elongated opening 18A' is provided in the respective outer side wall 5A', 10A'.

Outside the elongated openings 18A', an outer space **40*a*' and 40*b*', respectively, is provided. Supply lines 41*a*' and 41*b*' are connected to these outer spaces 40*a*' and 40*b*'** respectively, for the first fluid.

As mentioned in the preamble to this patent specification, intermittent, violent steam implosions may arise when steam is mixed into a fluid, causing chocks and vibrations. In order to attenuate such chocks and to prevent or reduce any vibrations of the flow restrictor member 6', the following provisions are made. Each of the two side walls 7', 8' of member 6' is provided with a recess 62 on the side of the wall facing the gap 15' or 16'. The recesses 62 take up the major part of the wall sides and are covered by a thin sheet 63 of stainless steel. The covered recesses 62 may be filled with sand, lead or steel shots, rubber or any other chock dampening material in a manner which may be known per se. Similar dampening members can be provided on the walls 5B' and 10B' of the flow chamber 39' for additional damping action.

The operation of the apparatus A' shown in FIG. 5 corresponds to the above described operation of the apparatus A according to the previous embodiment. Therefor, reference is made to the previous description regarding the operation.

In the above description of the embodiment according to FIG. 5, it was mentioned that the axis 24' preferably is displaced towards the bottom end wall 48' of the flow restrictor member 6' in order to counteract tilting of the flow restrictor member 6' in the flow chamber 39'. The embodiment according to FIG. 6 shows another way of efficiently preventing such tilting. According to this embodiment, the two center axes 24' and 24" of pistons 25' and 26', respectively, are parallel and displaced relative to each other. Preferably, they are displaced in such a way that the axes 24' and 24" are in a vertical plane coinciding with the plane of symmetry of the flow restrictor member 6'.

Figure 7:
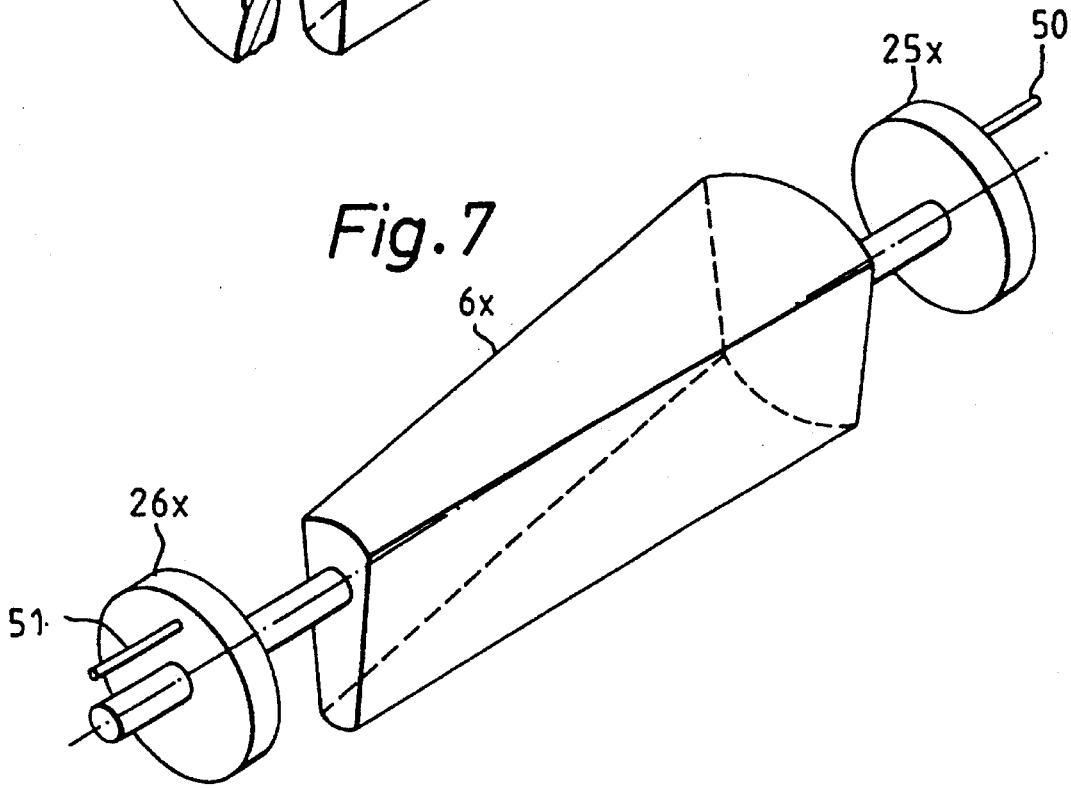
FIG. 7 is a perspective view of a flow restrictor member included in an apparatus according to yet another embodiment of the invention.

In the embodiment of FIG. 7, a guide pin 50, 51 is used on each of the pistons **25*x* and 26*x*, or optionally on only one of these in order to prevent tilting of the flow restrictor member 6*x*. The guide pins 60, 61** are parallel with the piston axis and are housed in the respective cylinder house (not shown).

The above-described apparatus A, A' according to the invention exhibit a large number of advantages over apparatuses according to the prior art. The apparatus of the present invention have a substantially simpler design, are very compact and are simple to install in existing pipe systems. Simpler installation can be achieved by the fact that a pipe, in which the apparatus A, A' are to be mounted, only needs to be cut off in two places in order to accommodate the apparatus, after which the apparatus is suitably connected, e.g., by a flange joint, to the thus cut-off pipe, with the pipelines 32 and 33 above corresponding to the cut-off parts of the pipe. No stand or base is needed to support the apparatus A, A' which also facilitates installation.

A further advantage is that the principal flow, i.e., the flow of the pulp suspension (the second fluid), does not need to alter its principal flow direction through the apparatus A, A' which means that a high velocity of the fluid through the gaps 15, 16 can be maintained. This high velocity through the gaps 15, 16 enhances the distribution of the added steam or other first fluid in the second fluid (pulp suspension), thereby also reducing the risk of implosions. If such implosions should nevertheless occur, they will occur downstream and will not therefore cause any serious problems.

Another advantage of the apparatus A is that, as a result of its design, particularly its mounting, it effectively inhibits blockage. This is largely due to the fact that the flow restrictor member 6 has a certain freedom of movement both in its longitudinal direction and about its longitudinal axis.

It will be appreciated that the present invention is not limited to the exact construction that has been described above and illustrated in the accompanying drawings, and that various modifications and changes can be made without departing from the scope thereof. It is intended that the scope of the invention only be limited by the appended claims.

What is claimed is:

1. An apparatus for mixing a first fluid into a second fluid, comprising:

a housing having a flow chamber, the flow chamber defining a principal direction of flow for the second fluid, the flow chamber having first and second walls that converge in a wedge shape as viewed in a plane transversely to the principal direction of flow of the second fluid;

a flow restrictor member disposed in the flow chamber, the flow restrictor member having first and second sides that converge in a wedge shape as viewed in a plane transversely to the principal flow direction of the second fluid;

a first gap formed between the first side of the flow restrictor member and the first wall of the flow chamber;

a second gap formed between the second side of the flow restrictor member and the second wall of the flow chamber; and means for introducing the first fluid into at least one of the first and second gaps, the means for introducing the first fluid being disposed in the region of said first and second gaps.

2. The apparatus according to claim 1, wherein the first and second sides of the flow restrictor member taper in a wedge shape in a direction which coincides linearly with but is aimed directly counter to the principal direction of flow of the second fluid.

3. The apparatus according to claim 2, wherein the flow restrictor member has a longitudinal axis transverse to the principal direction of flow of the second fluid, said restrictor member being moveable along said longitudinal axis relative to the first and second walls of the flow chamber, thereby altering the width of the first and second gaps.

4. The apparatus according to claim 3, wherein the flow restrictor member has first and second ends, and is mounted in bearing members at said first and second ends.

5. The apparatus according to claim 4, wherein the bearing members comprise cylinders in which cylindrical pistons are mounted, said pistons being joined to both ends of the flow restrictor member, enabling the flow restrictor member to be rotated about said longitudinal axis.

6. The apparatus according to claim 5, wherein inner sides of the cylindrical pistons facing towards the flow restrictor member are in fluid communication with said flow chamber.

7. The apparatus according to claim 6, further comprising a control cylinder means for moving the restrictor member along the longitudinal axis of the restrictor member for regulating the width of the first and second gaps.

8. The apparatus according to claim 7, wherein a first one of the cylindrical pistons, which is closest to the control cylinder means, has an inner surface area in fluid communication with the flow chamber that is larger than an inner surface area of a second one of the cylindrical pistons in fluid communication with the flow chamber, which is placed on the other end of the restrictor member.

9. The apparatus according to claim 1, wherein said means for introducing the first fluid into the gaps comprises holes formed in the first and second walls of the flow chamber facing towards the flow restrictor member.

10. The apparatus according to claim 9, wherein the holes are located closer to inlet openings of the first and second gaps than to outlet openings of the gaps.

11. The apparatus according to claim 9, wherein the holes have a conically tapered shape that widens in a flow direction of said first fluid therethrough.

12. The apparatus according to claim 1, wherein the first and second gaps widen in the direction of flow of the second fluid when the flow restrictor member is disposed symmetrically in the flow chamber.

13. The apparatus according to claim 1, further comprising a governor means for measuring a differential between the pressures downstream and upstream of inlet and outlet openings of the apparatus, and for displacing the flow restrictor member transversely to the direction of flow of the second fluid through the apparatus in dependence upon the measured pressure differential.

14. The apparatus according to claim 1, wherein at least one of the surfaces defining the first and second gaps is uneven.

15. The apparatus according to claim 14, wherein the unevenness comprises longitudinal grooves or recesses in said at least one of the surfaces.

16. The apparatus according to claim 15, wherein said first and second walls of the flow chamber have a longitudinal direction which is transversal to the main flow direction of the fluid flowing through the gap, and said recesses or grooves extend along said longitudinal direction of the first and second walls.

17. The apparatus according to claim 1, wherein surfaces of the flow chamber and the flow restrictor member that face the first and second gaps are uneven, and are provided with longitudinal recesses or grooves transversal to the flow direction of the second fluid.

18. The apparatus according to claim 1, further comprising means for preventing tilting of the flow restrictor member in the flow chamber.

19. The apparatus according to claim 1, further comprising a chock dampening means provided on at least one of the surfaces defining said first and second gaps for reducing vibrations of the flow restrictor member.

20. The apparatus according to claim 19, wherein the chock dampening means is provided in the first and second sides of the flow restrictor member.

* * * * *